US007000674B1

(12) United States Patent
Johnson

(10) Patent No.: US 7,000,674 B1
(45) Date of Patent: Feb. 21, 2006

(54) TOY STORAGE CURTAIN WITH TOY POUCHES

(76) Inventor: Barbarann Johnson, 120 Fuller St., Everett, MA (US) 02149

( * ) Notice: Subject to any disclaimer, the term of this patent is extended or adjusted under 35 U.S.C. 154(b) by 209 days.

(21) Appl. No.: 10/707,002

(22) Filed: Nov. 13, 2003

(51) Int. Cl.
*A47H 19/00* (2006.01)

(52) U.S. Cl. ..... 160/349.2; 160/330

(58) Field of Classification Search ..... 160/330, 160/349.1, 349.2, DIG. 6, 405, 123; 4/558, 4/559, 608, 610
See application file for complete search history.

(56) References Cited

U.S. PATENT DOCUMENTS 2,251,512 A * 8/1941 Bush et al. ..... 248/201
2,593,218 A * 4/1952 Swain ..... 2/48
2,613,368 A * 10/1952 Rosenbaum ..... 4/608
4,278,714 A * 7/1981 Schwartz ..... 428/4
5,337,907 A * 8/1994 McKenzie et al. ..... 211/88.01
5,533,534 A * 7/1996 Cariello et al. ..... 132/286
5,761,751 A * 6/1998 Morrissey ..... 4/558
5,785,188 A * 7/1998 Ogden ..... 211/88.01
5,887,298 A * 3/1999 Semidey ..... 4/661
D409,873 S 5/1999 Johnson ..... D6/603
6,030,121 A * 2/2000 Strzyinski et al. ..... 383/39
D438,744 S 3/2001 Johnson ..... D6/579
6,216,933 B1 * 4/2001 Healy ..... 224/663
6,244,326 B1 * 6/2001 Grieco ..... 160/349.2
6,289,967 B1 * 9/2001 Moore ..... 160/330
D464,517 S 10/2002 Johnson ..... D6/575
6,705,380 B1 * 3/2004 Scolletta ..... 160/349.2
6,896,155 B1 * 5/2005 Jones et al. ..... 222/106

* cited by examiner

*Primary Examiner*—David M. Purol
(74) *Attorney, Agent, or Firm*—Mark P. White

(57) ABSTRACT

A toy storage curtain contains a toy-storage pocket affixed to the lower end of a curtain panel, and further includes a tieback which supports a tieback pouch which also is used to store toys. Soft, light toys, such as stuffed animals, are the best candidates for storage in this system. The toy-storage pocket is located in proximity to the floor, where a child may use itin a seated position. The toy-storage pocket is located about thirty-two inches from the floor, where the child may use the toy-storage pouch in a standing position.

4 Claims, 4 Drawing Sheets

TOY STORAGE CURTAIN WITH TOY POUCHES

BACKGROUND OF INVENTION

The prior art discloses various methods and devices used for the storage of toys. Typical types of storage devices include chests. For example, U.S. Pat. No. 4,103,455 discloses a toy chest in the shape of an animal; U.S. Des. Pat. No. 224,030 discloses a chest in the shape of a bear; and U.S. Des. Pat. No. 254,439 discloses a chest in the shape of a pig. Also included in the prior art are bins, typified by U.S. Pat. No. 4,736,847 which discloses a play bin made with a cover that stretches over a resilient frame simulating an animal form. Boxes for the purpose of toy storage include U.S. Pat. No. 4,781,643, which discloses a toy box in the shape of a tree with a hollow trunk.

All of these prior art patents require containers which take up valuable floor space in a child's bedroom or playroom.

The present invention, in contrast, does not use any floor space, but utilizes the surface of window curtains, or curtains used as decorations about sliding glass doors, to provide additional space for the storage of toys. The present invention provides pockets or pouches, attached to otherwise standard curtains, to allow for the storage of light-weight toys, such as stuffed animals and the like.

One embodiment of the present invention, which uses a storage pouch as part of a curtain tie-back, can be used without any physical alteration to pre-existing curtains. As a result, the present invention provides additional storage space for stuffed toys at a very modest cost, and without requiring rearrangement of furniture or the addition of additional closet space.

SUMMARY OF INVENTION

It is an object of the present invention to provide a means for storage of toys, particularly soft, light-weight, stuffed toys, in the curtain of a child's room.

In accordance with a first aspect of the present invention, the curtain contains a main panel and a pocket for the storage of articles such as toys, which is affixed to a front of the main panel in proximity to a lower end of the main panel.

In accordance with a second aspect of the invention, the pocket is separated into a number of separate compartments.

In accordance with a third aspect of the invention the pocket is affixed to the main panel approximately thirteen inches from a main panel bottom.

In accordance with a fourth aspect of the invention the pocket is separated into separate compartments by means of tucks.

In accordance with a fifth aspect of the invention contains an elastic band affixed near a top front edge of the pocket.

In accordance with a sixth aspect of the invention the pouch is affixed to the main panel by either sewing, gluing, riveting, snaps, or by hook and loop fasteners.

In accordance with a seventh aspect of the invention a pouch for storage of articles and a tieback belt affixed to the pouch are also included.

In accordance with an eighth aspect of the invention the pouch is slidingly affixed to the tieback belt.

In accordance with a ninth aspect of the invention an elastic band is affixed near a top front region of the pouch.

In accordance with a tenth aspect of the invention the pouch is further separated into a number of compartments.

In accordance with an eleventh aspect of the invention a number of loops are affixed to a back of the tieback pouches so that the tieback belt can be inserted within.

BRIEF DESCRIPTION OF DRAWINGS

These, and further features of the invention, may be better understood with reference to the accompanying specification and drawings depicting the preferred embodiment, in which.

DETAILED DESCRIPTION

The toy storage curtains of the present invention provide a convenient way for children to store toys in their rooms, especially soft toys, such as stuffed animals and the like. Using the curtains to provide storage is an inexpensive method of storage of such toys. Furthermore, the use of curtains for this purpose obviates the need for additional chests, drawers, closets, and the like, which take up valuable floor space.

Figure 1:
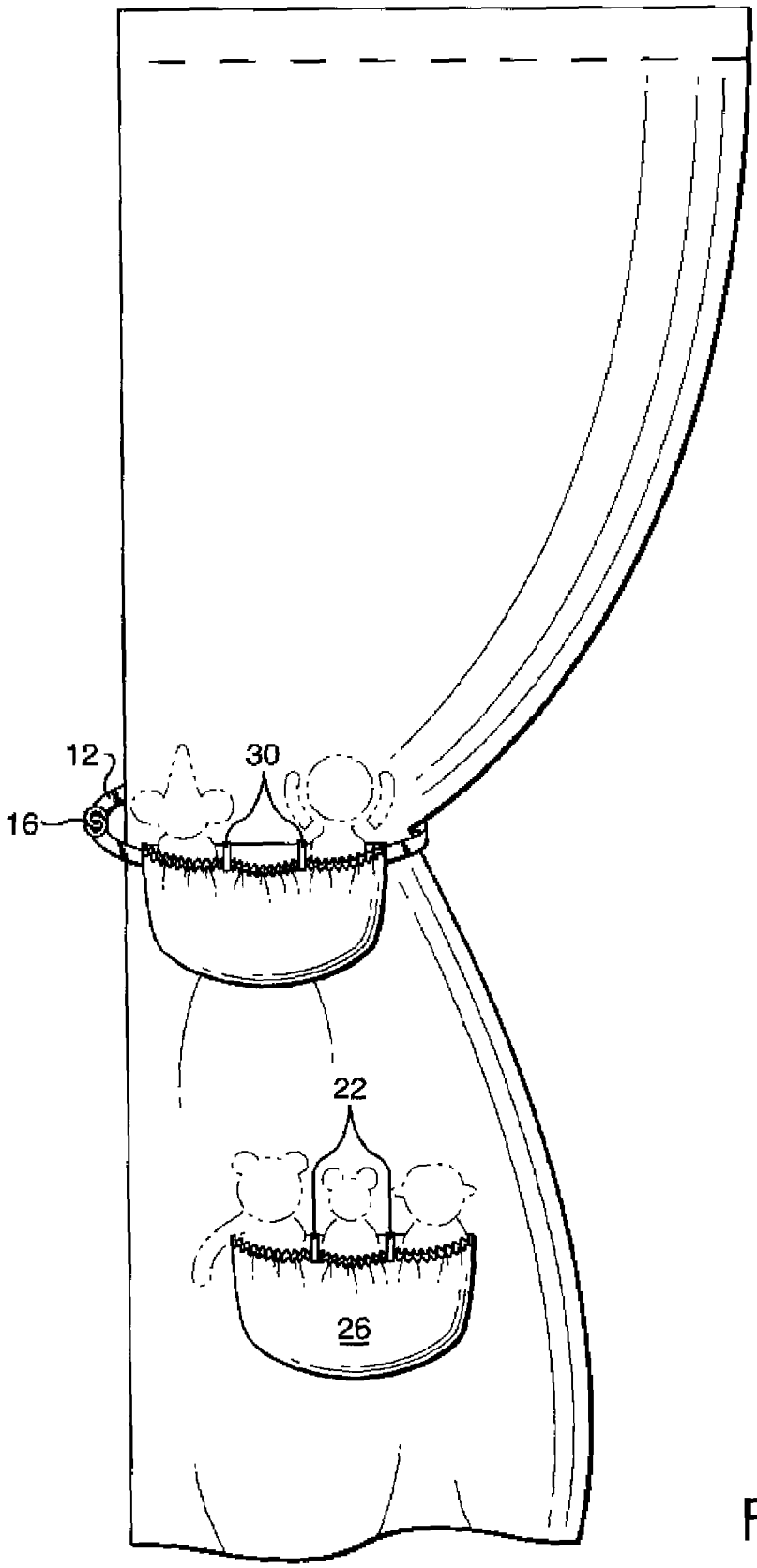
FIG. 1 depicts a curtain containing the lower pocket and the toy-storage tieback.

A completed curtain is shown in FIG. 1. The curtain displayed in this figure extends from the floor to above the top of a window of sliding glass door, which extends from the floor upwards to a distance of seven feet above the ground or more. The curtain can also be used with a window mounted several feet above the floor. Although a single curtain is shown in FIG. 1, in formal use the curtains will be mounted in pairs at either side of a window.

A lower pocket 26 is located a short distance from the floor, typically about thirteen inches from the floor to the top of the lower pocket, where a child kneeling or sitting will be easily able to access the pocket.

Figure 3:
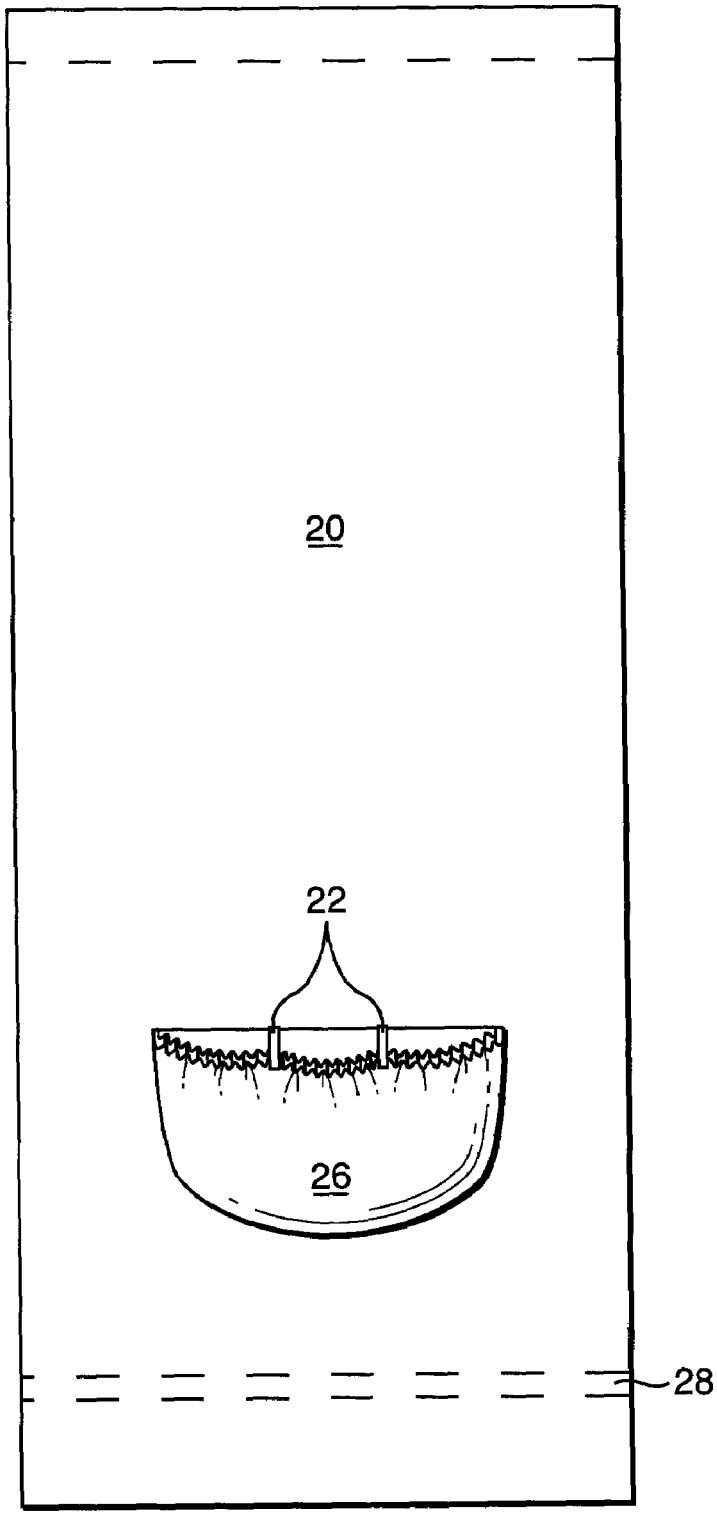
FIG. 3 depicts the curtain panel before sewing or gathering, in which the lower pocket is sewn onto the lower area of the curtain panel.

A second pocket, or pouch is affixed to a tieback belt 12, in a position accessible to a small child when standing. In the drawing of FIG. 3, this distance is about thirty-two inches from the floor to the top of the tieback pouch.

Creation of the Pockets

Referring now to FIG. 3, the procedure for creating the curtains will now be described. The curtains are fabricated from rectangular panels 20, in which a 3-inch hem at the bottom will be created, are in lengths of either 63 inches, 72 inches, 84 inches, or 90 inches. For all of these lengths, the width of the window panels will be 52 inches.

Starting with one of these window panels, after sewing in the bottom hem 28 and the top hem (shown in dotted lines at the top of the drawings), the top edge of a pocket is first sewn onto the panel at a height of 13 inches from the bottom of the curtain panel, after the panel is hemmed. At the start of this process, the pocket panel is 32 inches wide by 18 inches high. A 1½-inch hem is sewn on the top and bottom sides of the pocket material before the back side 10 of the pocket is sewn onto the curtain panel.

Figure 2A:
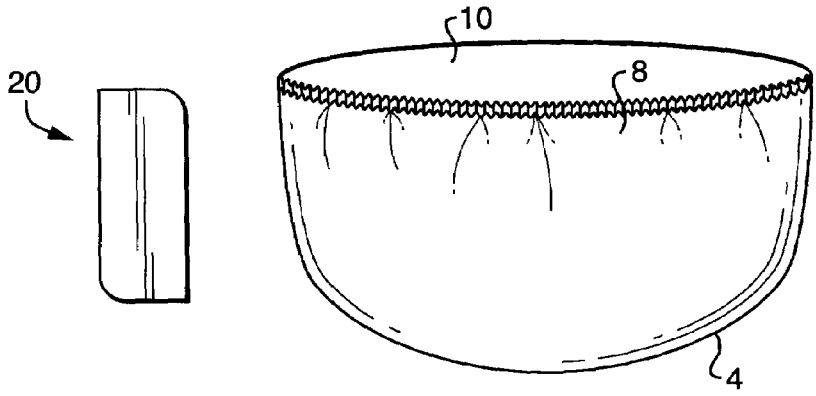
FIG. 2 A depicts a perspective view of the toy-storage pocket with an elastic sewn onto the top front edge of the pocket.
FIG. 2B depicts a perspective view of the tie-back pouch, as seen from the back of the pouch, with the tieback belt slidingly inserted through loops affixed to the back of the pouch.

Next, a 16-inch by 2-inch elastic band 8 is sewn permanently into the center of the hem at the bottom, leaving one inch on each side. The bottom of the pocket is brought up and aligned with the top, forming the pocket, as shown in FIG. 2A. The sides of the pocket are then gathered together and sewn onto the curtain panel. At this point the elastic band is contained within the hem near the top front edge of the pocket. The resulting pocket 26 is shown in FIG. 3 Once the pocket is sewn into the curtain two tucks 22 are sewn into the pocket to divide the pocket into three more-or-less equal compartments. Each tuck is essentially a vertical line of lines of thread sewn through both the front of the pocket 26 and the rear of the pocket 10. Each tuck extends from the top of the pocket downward for about an inch. Each tuck may be reinforced by sewing repeatedly up and then down, so that a number of parallel lines of thread connect the front and back of the pocket.

As a result, the top of the lower pocket is segregated into three areas which are more or less equal in size, into which the toys may be inserted. The bottom of the pocket is unsegregated, and makes up a single space.

Creation of the Tie-Back Pouches

Figure 2B:
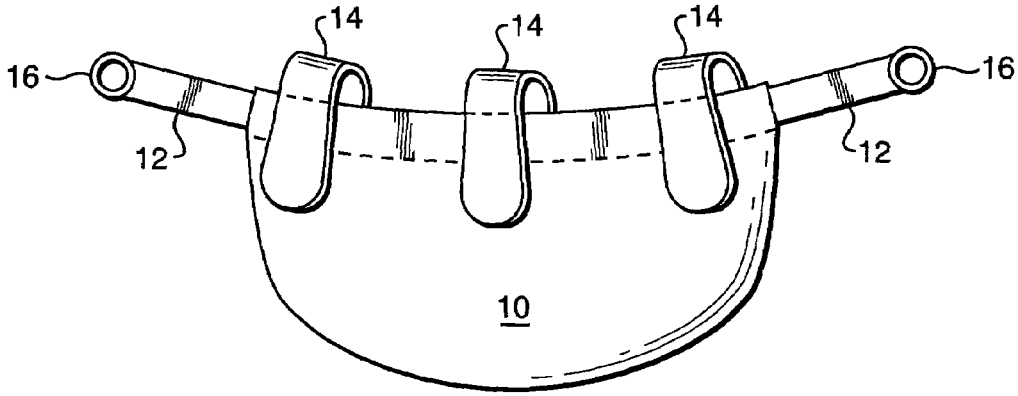
Figure 4:
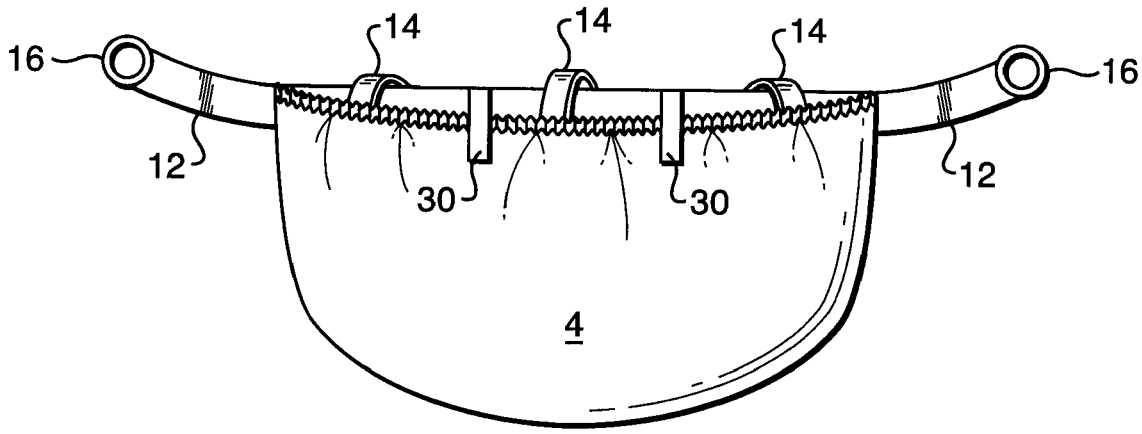
FIG. 4 depicts a perspective view of the tie-back pouch, as seen from the front of the pouch, with the tie-back belt slidingly inserted through loops affixed to the back of the pouch, and the tucks shown.

The tieback pouches are made the same way as the pockets with the same material. The process may be understood by first firstfirstreferring to FIG. 4. They are formed from the same size material as the pockets, that is, 32-inch by 18 inch cloth. However, the tie back pouches are not sewn onto the curtain panels. Instead, adjacent sides of the tie-backs are gathered together and sewn to each other, forming a pocket of material 4 not attached to the curtain panel. Next three loops of material 14 are sewn onto the back side of the back of the pocket, and they are looped over and sewn again on the front side of the back of the pocket forming the loops shown in FIG. 4. The loops are made from rectangular pieces, shown as reference number 20 in FIG. 2A. These pieces are folded in half along the long axis, and may then be sewn on to the back of the tieback pouch. The tieback belt 12 passes through the loops 14, and is used to tie the curtain back as shown in FIG. 4. FIG. 2B shows the pouch as viewed from the back. A tieback ring 16 terminates each end of the tieback belt. Two tucks 30 are sewn into the tieback pouch, creating three separate compartments, as with the lower pockets.

Referring now to FIG. 1 the lower pocket 26 has been affixed to the curtain panel and the pocket divided into three compartments by the two tucks 22. Several toys (in phantom) are inserted into the pocket.

FIG. 1 also shows the use of the tieback with tieback pouch holding additional toys (in phantom). In normal use, the two tieback rings 16 are restrained by a pin or hook (not shown) attached to the wall behind the curtain. Two tucks 30 in the tieback pouch separate the tieback pouch into three compartments as well, in the same way that tucks are sewn into the lower pocket.

Although the tieback pouch may be slid along the tieback belt anywhere along the belt, it is felt that the position shown in FIG. 1, with the tieback pouch centered at the front of the curtain, is the most attractive and efficacious position for locating the tieback pouch.

Although the present invention is intended for use in the storage of toys in a child's room, it is clearly useful for holding other articles, in other rooms of the house, at the discretion of the residents.

While the invention has been described with reference to specific embodiments, it will be apparent that improvements and modifications may be made within the purview of the invention without departing from the scope of the invention defined in the appended claims.

The invention claimed is:

1. A method for storing articles comprising the steps of:

(a) constructing a curtain tieback comprising a pouch, slidingly affixed to a tieback belt;

(b) affixing the tie-back belt to the curtain; and (c) constraining the curtain about a point approximately midway between a curtain bottom and a curtain top.

2. The method of claim 1, further comprising separating the pouch into a multiplicity of compartments.

3. The method of claim 2, further comprising the steps of:

(a) constructing a curtain comprising a main panel comprising a front, and further comprising a pocket, for the storage of articles; and (b) affixing the pocket to the front of the main panel in proximity to a lower end of the main panel.

4. The method of claim 3, further comprising affixing an elastic band in proximity to a front top edge of the top of the pouch.

* * * * *